US006761566B2

(12) United States Patent
Chin-Lung et al.

(10) Patent No.: US 6,761,566 B2
(45) Date of Patent: Jul. 13, 2004

(54) CARD CONNECTOR CARRIER STRUCTURE

(75) Inventors: Wu Chin-Lung, Yi-Lan County (TW); Peng Hsin Chen, Tao-Yuan County (TW); James Tseng, Tao-Yuan (TW)

(73) Assignee: High Tech Computer, Corp., Tao Yuan (TW)

( * ) Notice: Subject to any disclaimer, the term of this patent is extended or adjusted under 35 U.S.C. 154(b) by 0 days.

(21) Appl. No.: 10/249,923

(22) Filed: May 20, 2003

(65) Prior Publication Data

US 2004/0038563 A1 Feb. 26, 2004

(30) Foreign Application Priority Data

Aug. 23, 2002 (TW) ..... 91213137 U

(51) Int. Cl.[7] ..... H01R 12/00
(52) U.S. Cl. ..... 439/76.1; 439/945
(58) Field of Search ..... 439/76.1, 64, 945; 361/737

(56) References Cited

U.S. PATENT DOCUMENTS 5,176,523 A * 1/1993 Lai ..... 439/64
5,457,601 A * 10/1995 Georgopulos et al. ..... 361/686
5,505,628 A * 4/1996 Ramey et al. ..... 439/76.1
5,716,221 A * 2/1998 Kantner ..... 439/64
5,816,826 A * 10/1998 Colemen ..... 439/64
6,315,205 B1 * 11/2001 Bates, III ..... 361/737
RE38,089 E * 4/2003 Kajiura ..... 439/64

* cited by examiner

*Primary Examiner*—P. Austin Bradley
*Assistant Examiner*—X. Chung-Trans
(74) *Attorney, Agent, or Firm*—Jianq Chyun IP Office

(57) ABSTRACT

A card connector carrier structure, suitable for being mounted within a hand-held electronic device, comprises a circuit board (210) and a support tray (230) mounted to the circuit board. The circuit board is provided with a slot (216) through a thickness thereof. The support tray is formed from a thin sheet that includes a connector-receiving region (234) in the slot of the circuit board and an attachment member (232) attached to a surface (212) of the circuit board at a periphery of the slot. A card connector is further arranged in the connector-receiving region of the support tray within the slot of the circuit board. The card connector is thereby positioned within the slot, whereby an overall thickness of the card connector and the circuit board is reduced, and accordingly, a thickness of a hand-held electronic device incorporating the card connector and the circuit board can be reduced.

14 Claims, 2 Drawing Sheets

CARD CONNECTOR CARRIER STRUCTURE

CROSS REFERENCE TO RELATED APPLICATIONS

This application claims the priority benefit of Taiwan application serial no. 91213137, filed on Aug. 23, 2002.

BACKGROUND OF INVENTION

1. Field of the Invention

The invention relates generally to a card connector carrier structure and, more particularly, to a card connector carrier structure suitable for being mounted within a hand-held electronic device.

2. Description of the Related Art

Personal digital assistant (PDA) devices become increasingly more popular. Originally, the design of PDA had the purpose of constructing an electronic device that has the functions of scheduler, event recording, electronic directory, etc. As the processing speed of computers becomes increasingly higher and the Internet and wireless communication are developed, the PDA therefore incorporates more functions of wireless communication, Internet access, games, multi-media, etc. This extension of incorporated functions gives birth to the so-called "hand-held computers".

The PDA is usually provided with a limited amount of memory to store data. If the user wants to increase the memory capacity, an additional small memory card usually has to be connected to the PDA. Presently, numerous types and standards of memory cards exist, among which the secure digital (SD) cards and compact-flash (CF) cards are the most commonly used. To connect the additional memory card to the PDA, a card connector meeting the standard of the memory card must be provided in the PDA. Once the memory card is connected to the card connector, the PDA can access to the data stored in the memory card.

To increase the number of types of memory card the PDA can accommodate, two different types of card connector are respectively provided at top and bottom surfaces of the circuit board of the PDA. In this case, the two card connectors are usually assembled with the circuit board in a manner to have their respective card insertion slots oriented toward a front side of the PDA to facilitate the insertion and removal of the memory cards. However, with two card connectors, the thickness of the PDA, which principally includes the respective thickness of the upper and lower covers, the thickness of the circuit board and the respective thickness of the card connectors, is inevitably increased. With the traditional assembly structure, the incorporation of additional card connectors therefore adversely results in the increase of the PDA size.

Referring to FIG. 1 and FIG. 2, a perspective view and a side cross-sectional view schematically illustrate a traditional assembly of two card connectors with the circuit board of a PDA. As illustrated, a circuit board 110 of the PDA includes a first surface 112 (i.e. top surface) and an opposite second surface 114 (i.e., bottom surface) on which a first card connector 120 and a second card connector are respectively mounted. The first card connector 120 may be, for example, an SD card connector, and the second card connector may be, for example, a CF card connector. As illustrated in FIG. 2, the traditional assembly of the first card connector 120, the circuit board 110, and the second card connector 140 increases the thickness and size of the PDA.

SUMMARY OF INVENTION

An aspect of the invention is therefore to provide a card connector carrier structure, suitable for being mounted within a hand-held electronic device such as PDA, that can reduce the thickness of the hand-held electronic device.

To accomplish the above and other objectives, the invention provides a card connector carrier structure that comprises a circuit board of the hand-held electronic device and a support tray mounted to the circuit board of the hand-held electronic device. A slot is formed through a thickness of the circuit board, passing through a first and an opposite second surface of the circuit board. The support tray is formed by stamping a thin metal sheet including a recessed connector-receiving region located within the slot of the circuit board and an attachment member attached to the first surface of the circuit board at a periphery of the slot. The card connector is further arranged in the connector-receiving region of the support tray within the slot to reduce the thickness of the assembly of the card connector and the circuit board, and therefore the thickness of the hand-held electronic device.

In accordance with the above and other objectives, a second card connector is further mounted to the second surface of the circuit board.

It is to be understood that both the foregoing general description and the following detailed description are exemplary, and are intended to provide further explanation of the invention as claimed.

BRIEF DESCRIPTION OF DRAWINGS

The accompanying drawings are included to provide a further understanding of the invention, and are incorporated in and constitute a part of this specification. The drawings illustrate an embodiment of the invention and, together with the description, serve to explain the principles of the invention.

DETAILED DESCRIPTION

Figure 1:
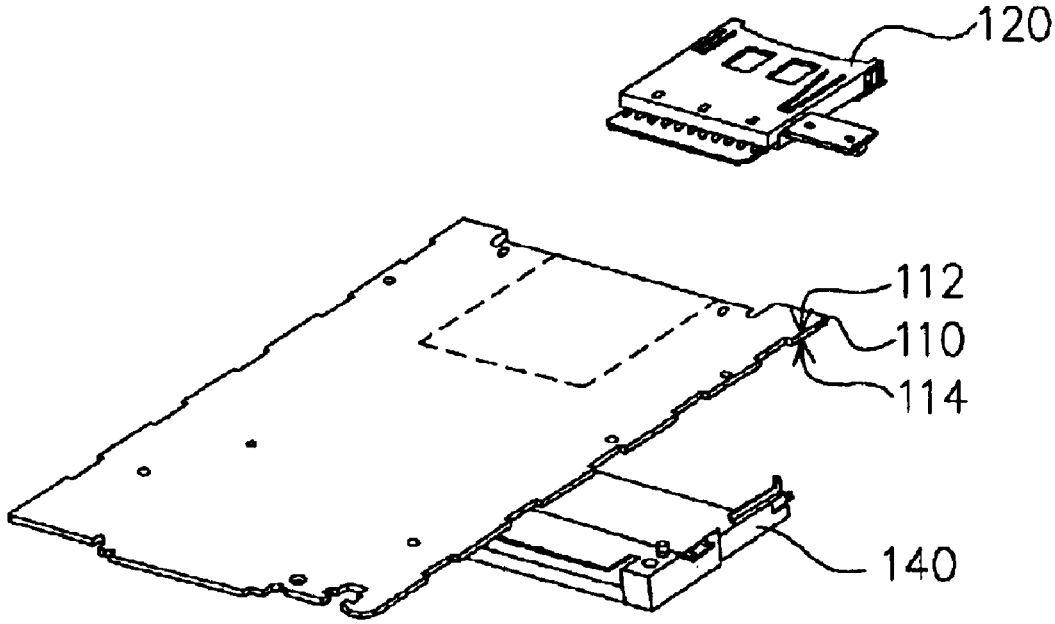
FIG. 1 (PRIOR ART)
FIG. 1 is an exploded view illustrating the traditional assembly of two card connectors and a circuit board in a PDA.

The following detailed description of the embodiment and example of the present invention with reference to the accompanying drawings is only illustrative and not limiting. Wherever possible in the following description and accompanying drawings, like reference numerals and symbols will refer to like elements and parts unless otherwise described.

Figure 3:
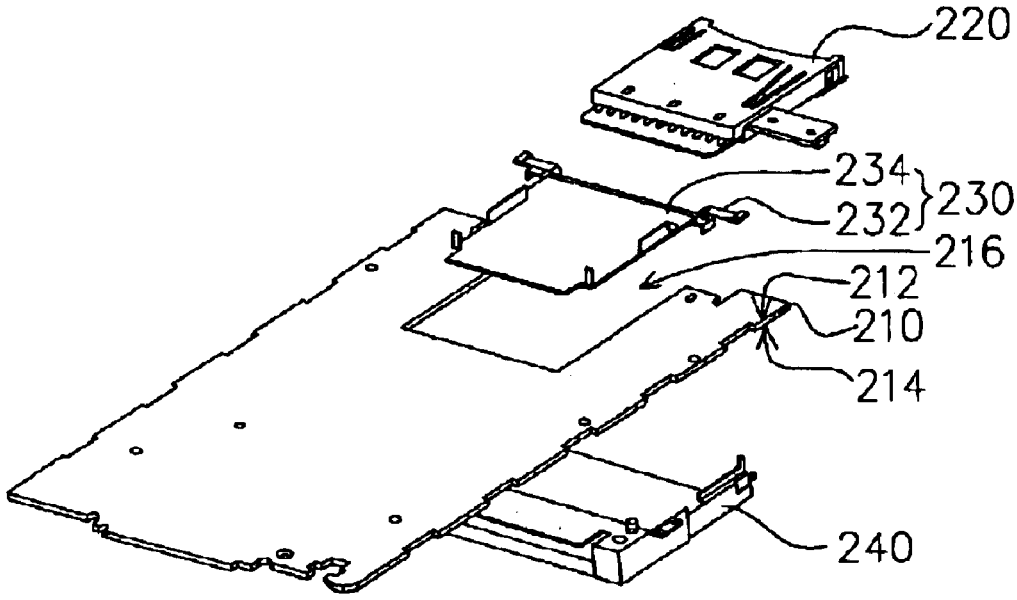
FIG. 3 is an exploded view illustrating the assembly of two card connectors and a card carrier structure in a PDA according to an embodiment of the invention.
Figure 4:
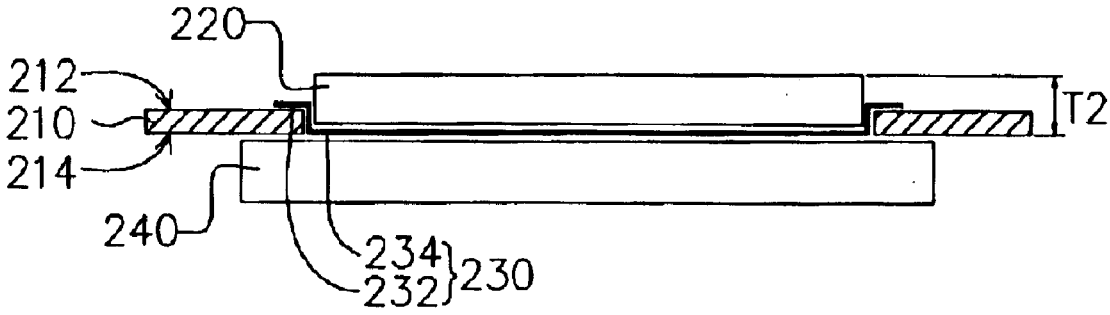
FIG. 4 is a side cross-sectional view schematically illustrating the assembly of two card connectors and a card carrier structure of FIG. 3.

Referring to FIG. 3 and FIG. 4, an exploded view and a side cross-sectional view schematically illustrate a card connector carrier structure mounted in a hand-held electronic device to carry two card connectors of the hand-held electronic device according to an embodiment of the invention. As illustrated, a card connector carrier structure of the invention comprises a circuit board 210 of the hand-held electronic device and a support tray 230 mounted to the circuit board 210. The hand-held electronic device is, for example, a personal digital assistant (PDA) device in this description, but it would be readily appreciated that many other types of electronic devices may be envisaged. The circuit board 210 of the PDA carries electronic components (not shown) that are electrically connected to one another via an electrical circuitry (not shown) formed on the circuit board 210. The circuit board 210 further includes a first surface 212 (i.e., top surface) and an opposite second surface 214 (i.e., bottom surface) where a first card connector 220 and a second card connector 240 of the PDA are to be respectively mounted. The first card connector 220 may be used to accommodate, for example, a secure digital (SD) card while the second card connector 240 may be used to accommodate, for example, a compact-flash (CF) card.

Figure 2:
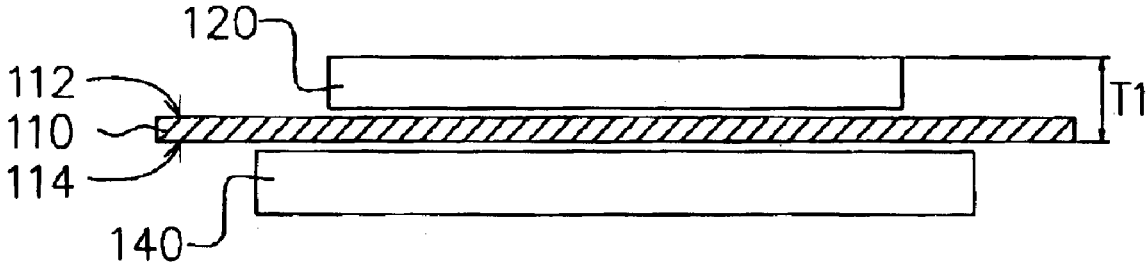
FIG. 2 (PRIOR ART)
FIG. 2 is a side cross-sectional view schematically illustrating the traditional assembly of two card connectors and a circuit board of FIG. 1.

In order to reduce the thickness of the PDA, a slot 216 is formed by mechanical processing in a side of the circuit board 210 at the mounting location of the first card connector 220. The slot 216 extends through the first and second surfaces 212, 214, and therefore a thickness of the circuit board 210. By mounting the first card connector 220 within the slot 216, the resulting thickness of the assembly of the first card connector 220 with the circuit board 210 is reduced, in comparison with the prior art as shown in FIGS. 1 and 2. To mount the first card connector 220 in the slot 216, a support tray 230 is provided. The support tray 230 is formed by stamping a thin metal (preferably, steel) sheet to include a recessed connector-receiving region 234. The support tray 230 is mounted to the circuit board 210 by positioning the connector-receiving region 234 within the slot 216 and fastening attachment members 232 formed by the support tray 230 beside the region 234 to the first surface 212 of the circuit board 210. Fastening the support tray 230 to the circuit board 210 may be achieved by methods known in the art such as welding or mechanical fitting and engaging attachments. By positioning the recessed connector-receiving region 234 within the. slot 216, the first card connector 220, disposed in the connector-receiving region 234, is therefore disposed within the slot 216. After the first card connector 220 is received in the connector-receiving region 234, the card connector 220 is electrically connected to the first face 212 of the circuit board 210.

As illustrated in FIG. 3 and FIG. 4, the support tray 230 is formed by stamping a thin steel or other metal sheet so that the connector-receiving region 234 of the support tray 230 is formed with a depth which is smaller than a thickness of the circuit board 210. The first card connector 220, arranged in the support tray 230, is thereby partially positioned within the slot 216. As a result, the thickness of the PDA can be thereby reduced. The thickness reduction is equal to the depth of the connector-receiving region 234.

As illustrated in FIG. 2, the thickness of the circuit board 110 substantially affects the thickness of the PDA when the circuit board 110 and the card connector 120 are assembled according to the traditional manner. In FIG. 2, the thickness obtained by the traditional assembly of the first card connector 120 with the circuit board 110 is denoted T1. In FIG. 4, the thickness obtained by the assembly of the circuit board 210 with the first card connector 220 according to the invention is denoted T2. Because a part of a thickness of the first card connector 120 is received in the receiving region 234, which is further inserted within the slot 216, the resulting assembly thickness T2 is therefore smaller than T1. After the first card connector 220 is mounted to connector-receiving region 234 of the support tray 230 and electrically connected to the first surface 212 of the circuit board 210, the second card connector 240 is mounted to the second surface 214 of the circuit board 210 and electrically connected thereto. As shown in FIG. 4, the second card connector 240 is located just below the first card connector 220.

As described above, the card connector carrier structure of the invention therefore principally comprises a circuit board of the PDA through which a slot is cut, and a support tray mounted to the slot of the circuit board. The slot cut through the circuit board is disposed at a location of the circuit board where the card connector is to be mounted. The support tray, provided with a recessed connector-receiving region, is mounted to the circuit board in a manner to have the connector-receiving region of the support tray positioned within the slot of the circuit board. As a result, the card connector, disposed in the connector-receiving region of the support tray, is mounted within the slot. With a portion of the card connector positioned within the slot of the circuit board, an overall thickness of the card connector and the circuit board is reduced, and the thickness of the PDA is therefore favorably reduced.

Besides PDA devices as described above, it will be readily appreciated that the invention can be also suitable for other types of hand-held electronic equipment requiring the mount of card connectors such as mobile phones or hand-held MP3 players. Provided with the card connector carrier structure of the invention, these hand-held devices therefore favorably have a smaller thickness.

It should be apparent to those skilled in the art that other structures that are obtained from various modifications and variations of various parts of the above-described structures of the invention would be possible without departing from the scope and spirit of the invention as illustrated herein. Therefore, the above description of the embodiment and example only illustrates specific ways of making and performing the invention that, consequently, should cover variations and modifications thereof, provided they fall within the inventive concepts as defined in the following claims.

What is claimed is:

1. A card connector carrier structure, suitable for being mounted within a hand-held device that includes at least a card connector, the card connector carrier structure comprising:

a circuit board, provided with a slot that is formed through a thickness of the circuit board between a first surface and an opposite second surface of the circuit board; and a support tray, formed from a thin sheet having a thickness smaller than the thickness of the circuit board, securely received in the slot of the circuit board, the support tray defining a recessed card-receiving region in the slot, wherein the at least a card connector is mounted in the recessed card-receiving region of the support tray.

2. The structure of claim 1, wherein a depth of the recessed connector-receiving region of the support tray is smaller than the thickness of the circuit board.

3. The structure of claim 1, wherein the support tray is made of a metallic material.

4. The structure of claim 1, wherein the support tray is made of steel.

5. The structure of claim 1, wherein the support tray has an attachment member fixedly attached to the first surface of the circuit board via welding.

6. The structure of claim 1, wherein the support tray has an attachment member fixedly attached to the first surface of the circuit board via mechanical fitting and engagement.

7. A card connector carrier structure, suitable for being mounted within a hand-held device that includes a first card connector and a second card connector, the card connector carrier structure comprising:

a circuit board, provided with a slot that is formed through a thickness of the circuit board between a first surface and an opposite second surface of the circuit board; and a support tray, formed from a thin sheet and including a recessed connector-receiving region within the slot of the circuit board and an attachment member attached to the first surface of the circuit board at a periphery of the slot, the first card connector being disposed in the recessed connector-receiving region of the support tray within the slot of the circuit board and electrically connected to the first surface of the circuit board and the second card connector being attached to the second surface of the circuit board.

8. The structure of claim 7, wherein the recessed connector-receiving region has a depth which is smaller than the thickness of the circuit board.

9. The structure of claim 7, wherein the support tray is made of a metallic material.

10. The structure of claim 9, wherein the support tray is made of steel.

11. The structure of claim 7, wherein the attachment member of the support tray is fixedly attached to the first surface of the circuit board via welding.

12. The structure of claim 7, wherein the attachment member of the support tray is fixedly attached to the first surface of the circuit board via mechanical fitting and engagement.

13. An electrical connector assembly, comprising:

a circuit board defining a first surface, a second surface opposite the first surface, and a slot through the first and second surfaces;

a support tray formed by a metal sheet, being fixedly secured to the first surface of circuit board, and defining a recessed receiving region in the slot;

a first card connector received in the recessed receiving region and electrically connected to the first surface of the circuit board; and a second card connector mounted on the second surface of the circuit board.

14. The electrical connector assembly of claim 13, wherein the second card connector is located just below the support tray and the first card connector.

* * * * *